US005416796A

United States Patent [19]

Fukuzawa et al.

[11] Patent Number: 5,416,796

[45] Date of Patent: May 16, 1995

[54] FLOAT MELTING APPARATUS AND METHOD EMPLOYING AXIALLY MOVABLE CRUCIBLES

[75] Inventors: Akira Fukuzawa; Kazuyuki Sakuraya; Toshiaki Watanabe, all of Tokyo; Motoo Yamazaki, Shizuoka; Tadashi Morita, Kanagawa; Tatsuo Take, Kanagawa; Michiru Fujita, Kanagawa, all of Japan

[73] Assignees: National Research Institute for Metals, Tokyo; Chubu Electric Power Company, Incorporated, Aichi; Fuji Electric Co., Ltd., Kanagawa, all of Japan

[21] Appl. No.: 67,149

[22] Filed: May 26, 1993

[30] Foreign Application Priority Data

Jun. 2, 1992 [JP] Japan ..... 4-140811

[51] Int. Cl.[6] ..... H05B 6/22

[52] U.S. Cl. ..... 373/156; 373/139; 373/148; 373/151

[58] Field of Search ..... 373/138, 139, 146, 155, 373/156, 45, 163, 147, 148, 150, 151; 219/600, 648, 418, 420, 434, 634

[56] References Cited

U.S. PATENT DOCUMENTS

| | | | |
|---|---|---|---|
| 3,478,156 | 11/1969 | Segsworth | 373/146 |
| 3,703,601 | 11/1972 | Babel | 373/163 |
| 4,873,698 | 10/1989 | Boen | 373/156 |
| 5,012,488 | 4/1991 | Stenzel | 373/156 |
| 5,058,127 | 10/1991 | Garnier et al. | 373/157 |
| 5,121,406 | 6/1992 | Hugo et al. | 373/142 |
| 5,280,496 | 1/1994 | Schlecht et al. | 373/158 |

FOREIGN PATENT DOCUMENTS

| | | |
|---|---|---|
| 1800431 | 1/1971 | Germany . |
| 2127333 | 12/1971 | Germany . |
| 3836239 | 4/1990 | Germany . |
| 4-123844 | 4/1992 | Japan . |

OTHER PUBLICATIONS

"Materials and Processes," vol. 5, No. 1, 1992, CAM-P-ISIJ vol. 5 (1992)-201 Discussion 23 Continuous Casting of Titanium Alloy Making Use of an Induction Cold Crucible by Tsutomu Tanaka and Koichi Kurita.

"Materials and Processes," vol. 5, No. 1, 1992, CAM-P-ISIJ vol. 5 (1992)-28 Discussion 22 Continuous Casting of Alloy Billets by Use of a Cold Crucible Melting, by Shingo Hitotsuyanagi and Noboru Idemukai.

*Primary Examiner*—Bruce A. Reynolds
*Assistant Examiner*—Tu Hoang
*Attorney, Agent, or Firm*—Finnegan, Henderson, Farabow, Garrett & Dunner

[57] ABSTRACT

Apparatus to float and melt particularly small pieces of high-melting point metal continuously while making the amount of meltable liquid metal greater than the capacity of a crucible. A conductive crucible having segments includes an upper cylindrical crucible portion and a lower closed-end crucible portion. An induction coil is arranged outside the upper crucible portion, whereas an induction coil is arranged below the induction coil. The lower crucible portion is in contact with the upper crucible portion and located on the inside of the induction coil at the initial melting stage. The lower crucible portion is lowered as a columnar metal grows and solidifies between molten metal and the lower crucible portion. A continuous feeder continuously feeds cold material. A molten metal surface thermometer and a molten metal surface level gauge are arranged above the crucible. The operation of the continuous feeder is regulated within a desired range of values of the molten metal surface thermometer. On the other hand, the lower crucible portion is successively lowered within a desired range of values of the molten metal surface level gauge.

12 Claims, 3 Drawing Sheets

FLOAT MELTING APPARATUS AND METHOD EMPLOYING AXIALLY MOVABLE CRUCIBLES

BACKGROUND OF THE INVENTION

1. Field of the Invention

The present invention relates to a float melting apparatus for melting a floating material by putting a material such as metal into a crucible made of a conductive material on the inside of an induction coil and making the metal float in the crucible.

2. Description of the Related Art

As the eddy current induced in metal flows in opposite directions in a crucible divided into segments in the float melting method, the forces resulting therefrom make the metal float in the crucible and cause it to be heated by its own eddy current. Since no impurities from the crucible are mixed with the molten metal, high purity liquid metal is produced. The liquid metal may be poured into a mold to manufacture products of extra high quality. The aforementioned method is employed for melting materials such as titanium and silicon. Moreover, the crucible is suitable for melting high melting-point materials because the liquid metal is free from thermal conductivity loss.

FIG. 4 is a vertical sectional perspective view of a conventional float melting apparatus. As shown in FIG. 4, there is arranged a cylindrical crucible 4 having a plurality of water-cooled copper segments 2 on the inside of a cylindrical high-frequency induction coil 1 and a bottom 3, the segments being electrically insulated from each other in the peripheral direction. When a cold metallic material 5 is put into the crucible 4 and simultaneously when power in the order of kHz is supplied from a power supply 6 to the induction coil 1, the metal 5 is caused to melt and float.

In the conventional float melting apparatus, only the upper metal portion melts and floats in the crucible, whereas the lower metal portion remains in contact with the bottom and side of the crucible. Consequently, the increased thermal loss incurred through the water-cooled crucible makes large electric power necessary to melt the metal. Moreover, the amount of liquid metal producible in one melting operation is determined by the size of the crucible. When the cold metal material is a small piece in the form of a thin metal sheet, it takes time to supply large electric power upon the principle of the proportional relationship between the size of the small piece and the intensity of the current induced therein; this makes it particularly difficult to melt a large amount of high melting-point material.

SUMMARY OF THE INVENTION

An object of the present invention is a float melting apparatus capable of continuously floating and melting small pieces of high melting-point metal by making greater the amount of meltable metal greater capacity of a crucible and a method of operating the same.

A float melting apparatus according to a first embodiment of the invention is provided with a conductive crucible having divided circumferential segments with an induction coil. The crucible includes an upper cylindrical crucible and a lower closed-end crucible, the upper crucible with the induction coil and the lower crucible being axially movable relative to each other.

A float melting apparatus according to a second embodiment is provided with a lower crucible drive unit for lowering the lower crucible in the first embodiment.

A float melting apparatus according to a third embodiment is arranged so that the induction coil in the first or second embodiment is vertically divided into a plurality of coils.

A float melting apparatus according to a fourth embodiment is arranged so that successively lower power supply frequencies are set for successively lower induction coils in the third embodiment.

A float melting apparatus according to a fifth embodiment is provided with a continuous cold material feeder above the crucible in the first, second, third, or fourth embodiment.

A float melting apparatus according to a sixth embodiment is provided with a heater for preheating the cold material fed in the fifth embodiment.

A float melting apparatus according to a seventh embodiment is arranged so that an upper induction coil wound outside the upper crucible is used as the heater in the sixth embodiment.

A float melting apparatus according to an eighth embodiment is provided with a molten metal surface level gauge or a molten metal surface thermometer in addition to the arrangement referred to in the first, second, third, fourth, fifth, sixth, or seventh embodiment.

According to a ninth embodiment of the invention, a method is provided for operating a float melting apparatus comprising a conductive crucible having an induction coil and divided circumferential segments, the crucible including an upper cylindrical crucible and a lower closed-end crucible. In the invention method, a columnar metal is made to grow and solidify between molten metal in the upper crucible, and the lower crucible by lowering the lower crucible while feeding cold material.

According to a tenth embodiment, a method is provided for operating a float melting apparatus comprising a conductive crucible having an induction coil and divided circumferential segments, the crucible including an upper cylindrical crucible and a lower closed-end crucible, a cold material feeder above the crucible, and a molten metal surface thermometer. In the invention method, a columnar metal is made to grow and solidify between the molten metal and the lower crucible by lowering the lower crucible while controlling the amount of the cold material being fed so as to let the value of the molten metal surface thermometer stay in a desired range.

According to an eleventh embodiment, a method is provided for operating a float melting apparatus comprising a conductive crucible having an induction coil and divided circumferential segments, the crucible including an upper cylindrical crucible and a lower closed-end crucible, a drive unit for lowering the lower crucible, and a molten metal surface level gauge. In the invention method, a columnar metal is made to grow and solidify between the molten metal and the lower crucible by lowering the lower crucible while controlling the rate of lowering the lower crucible so as to let the value of the molten metal surface level gauge stay in a desired range.

According to a twelfth embodiment, the method of operating a float melting apparatus in the ninth, tenth or eleventh embodiment comprises the steps of vertically dividing the induction coil into a plurality of coils and solidifying the surface of a columnar metal whose surface has been at least solidified on the lower side of the molten metal after that surface is melted again by the lower induction coil so that the surface roughness of the columnar metal may be improved.

BRIEF DESCRIPTION OF DRAWINGS

The accompanying drawings, which are incorporated in and constitute a part of this specification, illustrate a preferred embodiment of the invention and together with the description provide an explanation of the objects, advantages and principles of the invention. In the drawings.

DESCRIPTION OF THE INVENTION

Figure 1:
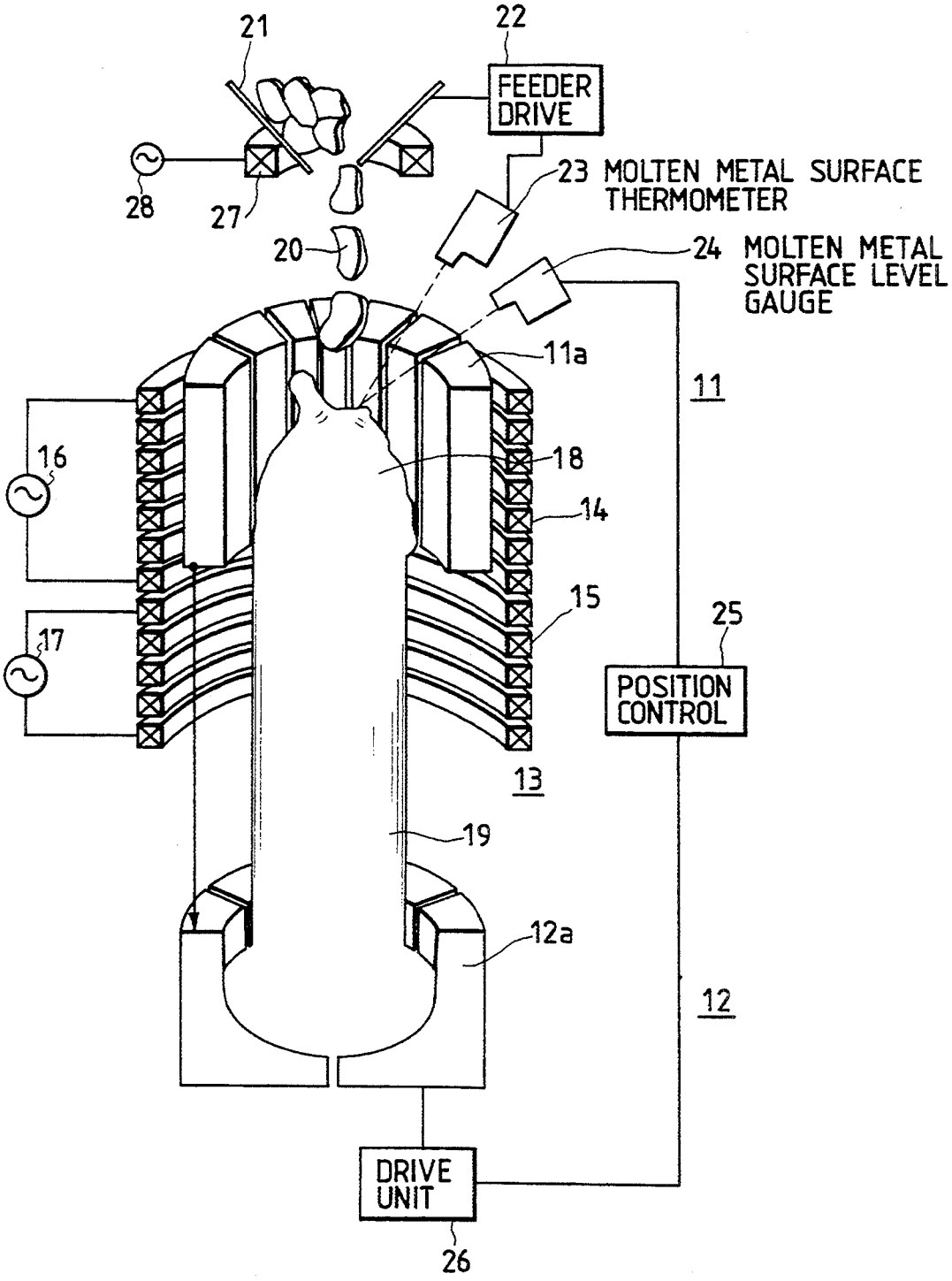
FIG. 1 is a vertical sectional perspective view of a float melting apparatus arranged in accordance with a first embodiment of the invention.
Figure 2:
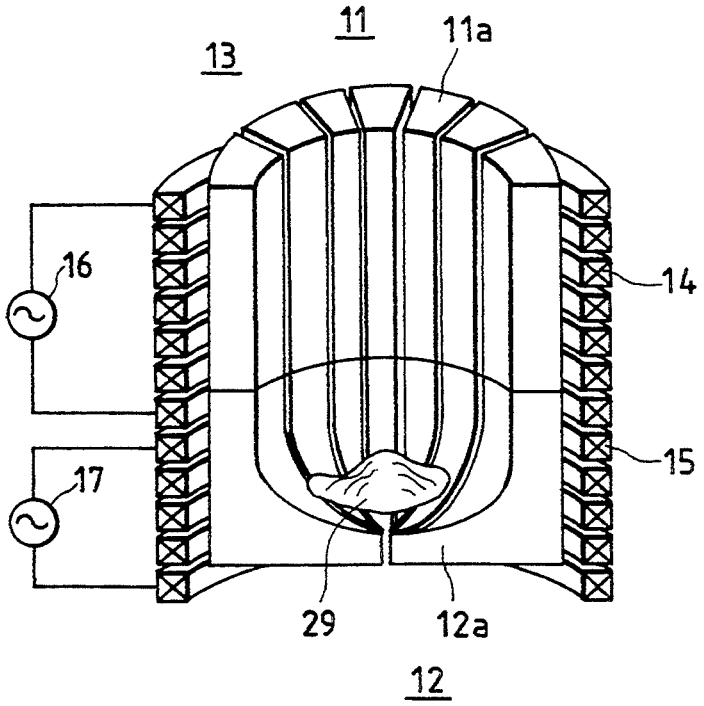
FIG. 2 is a vertical sectional perspective view of a crucible portion of the apparatus of FIG. 1 during an initial stage of operation.
Figure 4:
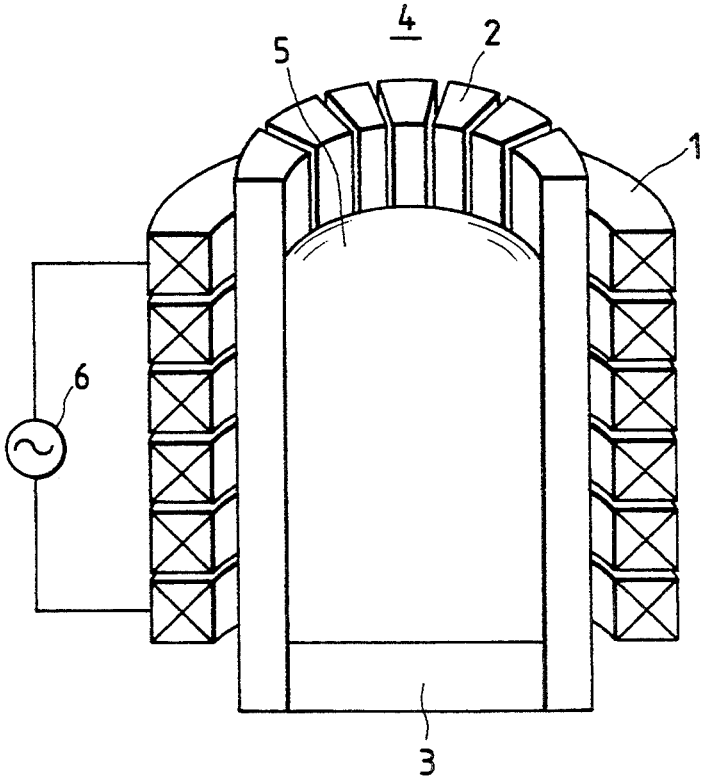
FIG. 4 PRIOR ART
FIG. 4 is a vertical sectional perspective view of a conventional float melting apparatus.
Figure 3:
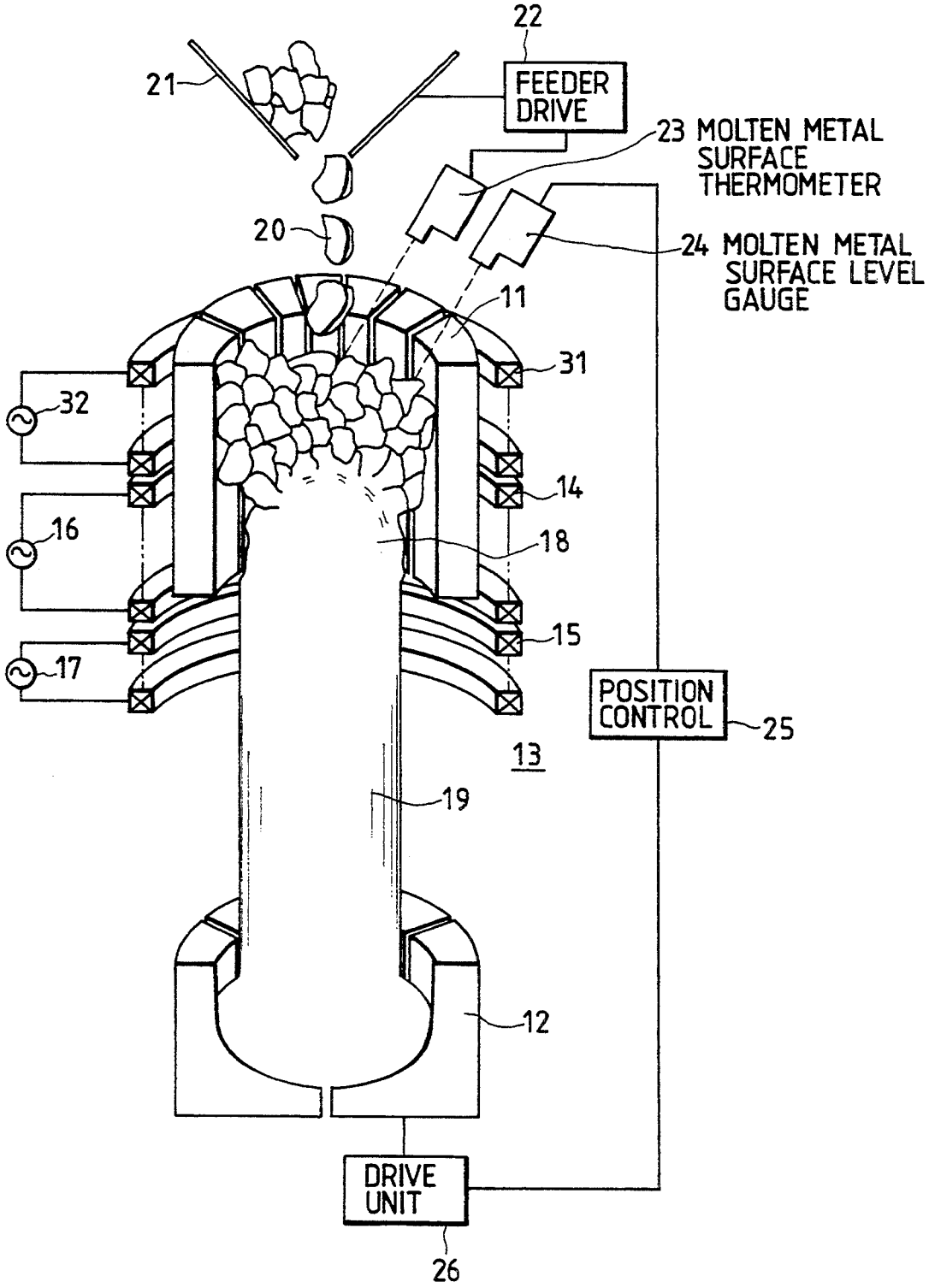
FIG. 3 is a vertical sectional perspective view of another float melting apparatus arranged in accordance with a second embodiment of the invention.

FIG. 1 is a vertical sectional perspective view of a float melting apparatus in operation as a first embodiment of the present invention. FIG. 2 is a vertical sectional perspective view of the principal part of FIG. 1 in the initial state. FIG. 3 is a vertical perspective sectional view of another float melting apparatus in operation as a second embodiment of the present invention. Like reference characters in these drawings designate like component parts having corresponding functions of which description may be omitted.

As shown in FIGS. 1 and 2, a conductive crucible 13 of copper having divided circumferential segments 11*a*, 12*a* includes an upper cylindrical crucible 11 and a lower closed-end crucible 12. An induction coil 14 is arranged outside the upper crucible 11, and as induction coil 15 is arranged below the induction coil 14.

As shown in FIG. 2, the lower crucible 12 is in contact with the upper crucible 11 and located on the inside of the induction coil 15 during an initial melting stage. The upper and lower crucibles are movable relative to each other, i.e., preferably the lower crucible 12 is lowered by a lower crucible drive unit 26 as a columnar metal 19 grows and solidifies between molten metal 18 being induction-heated and the lower crucible 12.

More specifically, a continuous feeder 21 such as a conveyer and a hopper for continuously feeding cold material 20, a molten metal surface thermometer 23 and a molten metal surface level gauge 24 are arranged above the crucible 13. When the temperature measured by the molten metal surface thermometer 23 exceeds a desired range, a feeder drive unit 22 drives the continuous feeder 21 so that a small amount of cold material 20 is successively fed. The feeder drive unit 22 stops driving the feeder 21 when the measured temperature becomes lower than the desired range.

On the other hand, a position control unit 25 drives the lower crucible drive unit 26 to lower the lower crucible 12 successively when the level of the molten metal measured by the molten metal surface level gauge 24 exceeds a desired range and stops lowering the lower crucible 12 when the level becomes lower than the desired range. Even though the cold material 20 is slow in melting from the heat generated by its own induction current since it is in small pieces, its melt rate is increased by heat transferred from the molten metal 18, which is at a high temperature. The lower crucible 12 is lowered as the solidified columnar metal 19 grows. The timing at which the cold material is fed and the lower crucible is lowered are appropriately regulated.

As the solidified columnar metal 19 grows, the power supplied to the lower group of induction coils 15 is so regulated as to improve the surface roughness of the columnar metal 19 by solidifying the surface of the columnar metal 19 whose surface has been at least solidified in the lower part of the molten metal 18 after that surface is melted again by the lower induction coil. The continuous feeder 21 may be provided with a power supply 28 and an induction coil 27 as a preheater.

During the initial melting stage shown in FIG. 2, the magnetic flux of the induction coil 15 infiltrates through slits between the segments extending to the bottom of the lower crucible 12, so that a small metal lump 29 on the bottom, where the effective magnetic flux intersects with each other, begins to melt efficiently while floating over the lower crucible 12. Even in a case where a small piece of metal is fed having a small induction current and less self-heating, the thermal capacity of molten metal is capable of melting the small piece to make the molten metal grow larger.

Consequently, the induction current further increases with the effect of accelerating the fusion. When the upper crucible 11 in intimate contact with the lower crucible 12 is completely filled with the molten metal, the lower crucible 12 is lowered so as to resume the operating condition. With the present embodiment, it is therefore possible to melt the cold material, particularly small pieces of high-melting point material, continuously at high speed even though the amount of the material is greater than the capacity of the crucible 13.

If the lower crucible 12 is made axially movable downward, the mechanism may be simplified. Otherwise the combination of the upper crucible 11 and the induction coils 14, 15 is made axially movable upward with the same effect. If, moreover, the lower induction coils 15 are connected to the proportionally lower frequency power supply 17, floating and heating are accelerated in the lower part of the molten metal 18 when it increases in volume to ensure the stability in the upper part of the molten metal, and only one induction coil instead of what has been divided into the plurality of coils may be used. A load cell is an example of the molten metal surface level gauge 24 arranged beneath the lower crucible 12. Both of the crucibles 11, 12 are water-cooled.

With the second embodiment shown in FIG. 3, there are provided, outside the upper crucible 11, the induction coil 14 for melting purposes on the lower side, a power supply 32 on the upper side and additionally an induction coil 31 as a preheater. The induction coil 31 replaces the induction coil 27 of FIG. 1 and renders the thermal structure of the continuous feeder 21 simple. Although the molten metal surface thermometer 23 is used to measure the temperature of cold material 20 piled up thereon instead of the actual temperature of the molten metal 18, this temperature is readily converted into the surface temperature of the molten metal 18.

FIGS. 1 and 2 are referred to in the description of the detailed operation of the first embodiment. During an initial melting stage (FIG. 2), the magnetic flux generated by an induction coil 15 infiltrates through slits between segments extending to the bottom of a lower crucible 12, so that a small metal lump 29 on the crucible bottom begins to melt and float over the lower crucible 12. Even in a case where there is fed a small piece of metal which generates only a small induction current with small self-heating the thermal capacity of molten metal under the small metal piece is capable of melting the small piece to make the molten metal grow larger. Consequently, the induction current further increases with the effect of accelerating the fusion.

When an upper crucible 11 in intimate contact with the lower crucible 12 is completely filled with the molten metal, the lower crucible 12 is lowered relative to the upper crucible 11 so as to resume the operating condition. Cold material that has been fed melts because of its own induction current and continues to melt on receiving the heat transferred from molten metal 18 of high temperature.

A columnar metal 19 which has solidified beneath the molten metal 18 grows and as it grows, the lower crucible 12 is lowered. It is therefore possible to melt the cold material, particularly small pieces of high-melting point material, continuously at high speed even though the amount of the material is greater than the capacity of the upper and lower crucibles 11, 12.

According to the second embodiment, a lower crucible drive unit 26 embodies a mechanism for lowering the lower crucible 12.

According to the third embodiment, induction heating most suitably applicable to the relevant molten metal existing in a horizontal cross section may be implemented if individual power supplies 16, 17 are connected to respective vertically divided induction coils 14, 15.

According to the fourth embodiment, the floating and heating on the lower side is accelerated if lower induction coils are respectively excited at proportionally lower frequency power supplies in descending order and the molten metal on the upper side is stabilized.

According to the fifth embodiment, a continuous feeder 21 is driven to feed a desired amount of cold material 20 at a time with desired timing.

According to the sixth embodiment, the cold material makes available the thermal stability of molten metal in the preheated crucible.

FIG. 3 is referred to in the seventh embodiment. The use of a preheating upper induction coil 31 wound outside the upper crucible 11 as the heater allows the coil to be structurally related to the other melting coils, thus simplifying the whole construction.

According to the eighth embodiment, the surface temperature and level of the molten metal 18 are measured by a molten metal surface thermometer 23 and a molten metal surface level gauge 24, and the thermometer and the level gauge are interlocked with the continuous feeder 21 and the lower crucible drive unit 26.

FIG. 1 is referred to in the ninth embodiment. When the upper crucible 11 is completely filled with molten metal, the lower crucible 12 is lowered to resume the operating condition. The cold material that has been fed melts from its own induction current and continues to melt on receiving heat transferred from molten metal 18 of high temperature. The columnar metal 19 which has solidified beneath the molten metal 18 grows and as it grows, the lower crucible 12 is further lowered.

The molten metal 18 between the upper crucible 11 and the lower crucible 12 is always maintained at the level of the induction coil 14 and consequently cold material 20 being newly fed can be properly processed. It is, therefore, possible to melt the cold material, particularly small pieces of high-melting point material, continuously at high speed even though the amount of the material is greater than the capacity of the upper and lower crucibles 11, 12.

FIG. 1 is referred to in the tenth embodiment. When the temperature of the molten metal measured by the molten metal surface thermometer 23 exceeds a desired level, a feed drive unit 22 drives the continuous feeder 21 so as to feed successive small amounts of cold material 20 at a time. The feed drive unit 22 is also designed to stop the feeding operation when the measured temperature becomes lower than the desired level. Despite the progress of induction heating, the columnar metal 19 is caused to grow as the cold material 20 is successively fed as long as the temperature of the molten metal 18 stays in a desired range.

FIG. 1 is referred to in the eleventh embodiment. When the level of the molten metal measured by the molten metal surface level gauge 24 exceeds the desired range, a position control unit 25 drives the lower crucible drive unit 26 to lower the lower crucible 12 incrementally. The position control unit 25 is also designed to stop the lower crucible 12 from descending further when the value of the molten metal surface level gauge 24 becomes lower than the desired range. Despite the growth of the columnar metal 19, the molten metal 18 is held in position within the upper crucible 11.

FIG. 1 is referred to in the twelfth embodiment. The induction coil is divided into a plurality of coils; an upper induction coil 14 and a lower induction coil 15. As the solidified columnar metal 19 grows, the power supplied to the lower induction coil 15 is so regulated as to improve the surface roughness of the columnar metal 19 by solidifying the surface of the columnar metal 19 whose surface has been at least solidified in the lower part of the molten metal 18 after that surface is melted again by the lower induction coil.

The float melting apparatus according to the first embodiment has the effect of floating and melting even small pieces of high-melting point material continuously at high speed while setting the amount of the cold material that can be melted to an amount greater than the capacity of the crucible since the material is quickly made to melt and float during the initial melting stage and since the columnar metal is grown and solidified between the upper and lower crucibles in the normal operating condition. The second embodiment has the effect of moving only the water-cooled lower crucible while the upper crucible, complicated in structure, the induction coil and the power supply connected thereto are held at a standstill.

The float melting apparatus according to the third embodiment has the effect of subjecting to induction heating the meltable metal within the horizontal section of each of the induction coils vertically divided from each other. The fourth embodiment has the effect of floating and melting the material at high speed by supplying greater power since the floating and heating on the lower side is accelerated while the molten metal on the upper side is stabilized.

The float melting apparatus according to the fifth embodiment has the effect of feeding successive desired amounts of cold material at a time with desired timing by means of the continuous feeder. The sixth embodiment has the effect of floating and melting the material at high speed since thermal stability is obtainable from the molten metal in the preheated crucible.

Further, the seventh embodiment has the effect of making the mechanical structure simple since the heater and the other melting coils are structurally related to each other.

The eighth embodiment has the effect of having the surface temperature and level of the molten metal related to the continuous feeder and the lower crucible drive unit since they are measured by the molten metal surface thermometer and molten metal surface level gauge without relying on skilled labor.

The method of operating the float melting apparatus according to the ninth embodiment has the effect of floating and melting particularly small pieces of high-melting point material continuously at high speed while making the amount of the cold material that can be melted greater than the capacity of the crucible since the material is quickly made afloat and melted at the initial melting stage and since the columnar metal is grown and solidified between the upper and lower crucibles in the normal operating condition.

The method of operating the float melting apparatus according to the tenth embodiment has the effect of making the columnar metal automatically grow by successively feeding the cold material since the temperature of the molten metal is accommodated in the desired range even though the induction heating progresses. The method of operating the float melting apparatus according to the eleventh embodiment has the effect of allowing float melting to progress with stability since the molten metal in the upper crucible is held in position despite the growth of the columnar metal. The method of operating the float melting apparatus according to the twelfth embodiment has the effect of improving the surface roughness of the columnar metal since the surface of the lower molten metal is solidified after the solidified surface of the columnar metal is melted again.

The foregoing description of the preferred embodiment has been presented to illustrate the invention. It is not intended to be exhaustive or to limit the invention to the form disclosed.

In applying the invention, modifications and variations can be made by those skilled in the pertaining art without departing from the scope and spirit of the invention. It is intended that the scope of the invention be defined by the claims appended hereto, and their equivalents.

What is claimed is:

1. A float melting apparatus comprising a conductive crucible formed from divided segments circumferentially disposed within an induction coil, said crucible including an upper cylindrical crucible portion and a lower closed-end crucible portion, and means for moving said upper crucible portion with said induction coil and said lower crucible portion axially relative to each other.

2. A float melting apparatus as claimed in claim 1, further comprising a lower crucible drive unit for lowering said lower crucible.

3. A float melting apparatus as claimed in claim 1 or 2, wherein said induction coil is vertically divided into a plurality of coils.

4. A float melting apparatus as claimed in claim 3, wherein lower induction coils are respectively connected to proportionally lower frequency power supplies in descending order.

5. A float melting apparatus as claimed in claim 1 or 2, further comprising a continuous cold material feeder installed above said crucible.

6. A float melting apparatus as claimed in claim 5, further comprising a heater for preheating the cold material being fed.

7. A float melting apparatus as claimed in claim 6, wherein an upper induction coil wound outside said upper crucible is used as said heater.

8. A float melting apparatus as claimed in claim 1 or 2, further comprising a molten metal surface level gauge or a molten metal surface thermometer.

9. A method of operating a float melting apparatus comprising a conductive crucible disposed within an energized induction coil and formed by divided circumferential segments, said crucible including an upper cylindrical crucible portion and a lower closed-end crucible portion, the steps of the method comprising:

feeding cold material to said upper crucible portion; and making a columnar material grow and solidify between said lower crucible portion and molten material in said upper crucible portion by lowering said lower crucible portion.

10. A method of operating a float melting apparatus comprising a conductive crucible having an energized induction coil and divided circumferential segments, the crucible including an upper cylindrical crucible portion and a lower closed-end crucible portion, a cold material feeder above said crucible, and a molten material surface thermometer, the steps of the method comprising:

feeding cold material to said upper crucible portion;

making a columnar material grow and solidify between said lower crucible portion and molten material in said upper crucible portion by lowering said lower crucible portion; and controlling the amount of said cold material being fed so as to hold the value of said molten material surface thermometer in a desired range.

11. A method of operating a float melting apparatus comprising a conductive crucible having an energized induction coil and divided circumferential segments, said crucible including an upper cylindrical crucible portion and a lower closed-end crucible portion, a drive unit for lowering said lower crucible portion, and a molten material surface level gauge, the steps of the method comprising:

feeding cold material to said upper crucible portion;

making a columnar material grow and solidify between said lower crucible portion and molten material in said upper crucible portion by lowering said lower crucible portion; and controlling a rate of lowering said lower crucible portion so as to hold the value of said molten material surface level gauge in a desired range.

12. A method of operating a float melting apparatus as claimed in claim 9, or 10 or 11, the steps of the method further comprising vertically dividing said induction coil into a plurality of coils and solidifying the surface of a columnar material whose surface has been at least solidified in the lower part of said molten material after melting the surface thereof again by said lower induction coil so that the surface roughness of said columnar metal is improved.

* * * * *